United States Patent [19]

Weathers

[11] 4,121,201

[45] * Oct. 17, 1978

[54] CARRIER CURRENT APPLIANCE THEFT ALARM

[75] Inventor: Paul Weathers, Haddon Heights, N.J.

[73] Assignee: Bunker Ramo Corporation, Oak Brook, Ill.

[ * ] Notice: The portion of the term of this patent subsequent to Sep. 17, 1994, has been disclaimed.

[21] Appl. No.: 454,033

[22] Filed: Mar. 22, 1974

[51] Int. Cl.[2] ..... G08B 13/14

[52] U.S. Cl. ..... 340/524; 340/538; 340/568; 340/687

[58] Field of Search ..... 340/280, 416, 288, 310 A; 310/8.6

[56] References Cited

U.S. PATENT DOCUMENTS

| | | | |
|---|---|---|---|
| 3,204,245 | 8/1965 | Dykaar | 340/416 |
| 3,289,194 | 11/1966 | King | 340/280 |
| 3,407,400 | 10/1968 | Lurie | 340/280 |
| 3,480,940 | 11/1969 | Lieser | 340/416 |
| 3,544,984 | 12/1970 | Hanson | 340/280 |
| 3,852,740 | 12/1974 | Haymes | 340/416 |
| 3,886,534 | 5/1975 | Rosen et al. | 340/310 A |
| 3,914,757 | 10/1975 | Finlay, Jr. et al. | 340/310 A |
| 3,925,763 | 12/1975 | Wadhwani et al. | 340/310 A |

*Primary Examiner*—Glen R. Swann, III

*Attorney, Agent, or Firm*—William Lohff; F. M. Arbuckle

[57] ABSTRACT

A simply installable, economical, room of a motel or hotel unit is provided in each room and an electrical device to be protected is connected to the room unit without the need for any modification of the device. The room unit is of sufficient sensitivity to sense various conditions indicative of an attempted theft, including the difficult to sense condition of cutting the power cord of the electrical device when the device is off. Each room unit is responsive to the detection of a condition indicating an attempted theft to produce a unique alarm signal which is coupled back to the AC power lines. The power supply lines of a plural phase AC power system customarily provided in the hotel or motel are used to transmit the alarm signals from the room units to receiving means for detection, and spare telephone lines which are customarily also available are used to transmit the detected alarm signals from the receivers to a central monitoring location. A vibrating reed system employing piezoelectric reeds as the frequency controlling elements as well as the driving and sensing transducers is used in the room units and in other portions of the system for providing highly stable tuning of oscillators and filters.

18 Claims, 8 Drawing Figures

FIG. 1
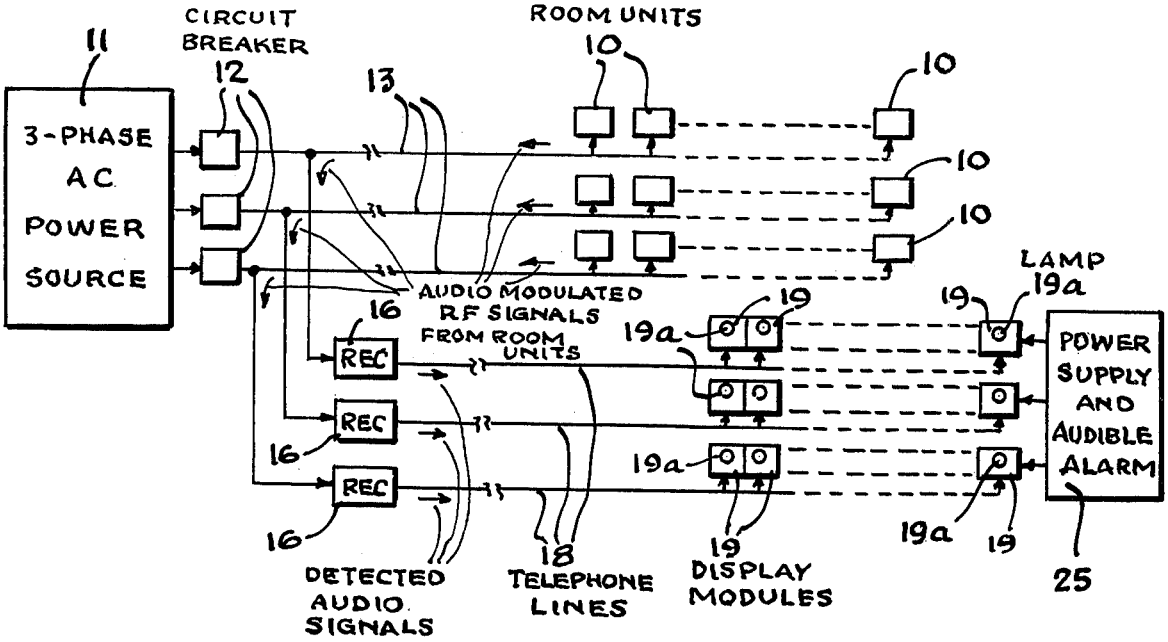
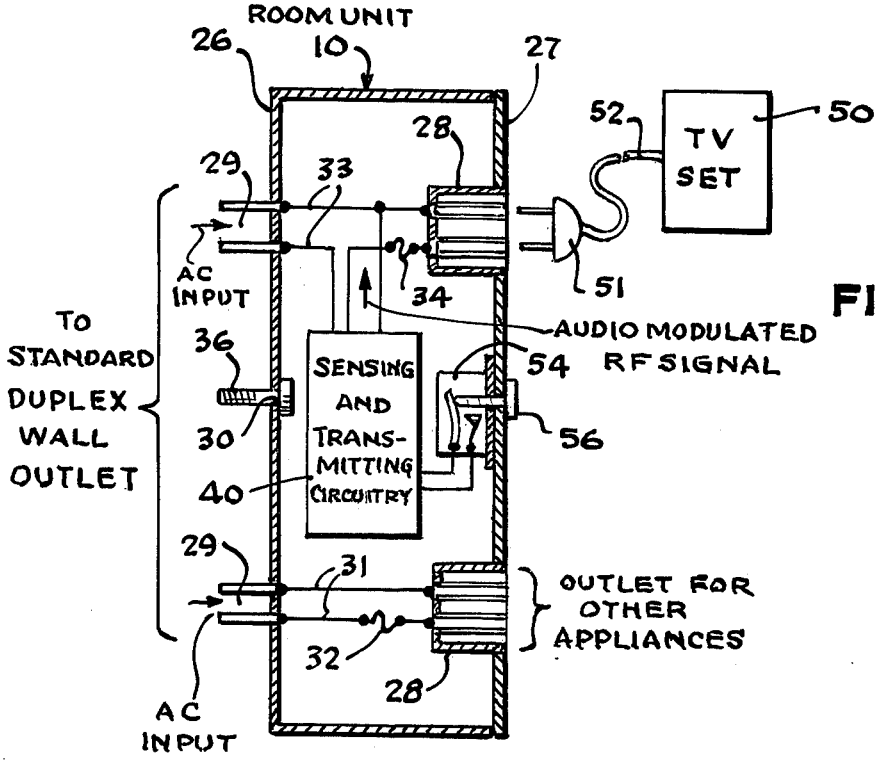
FIG. 2

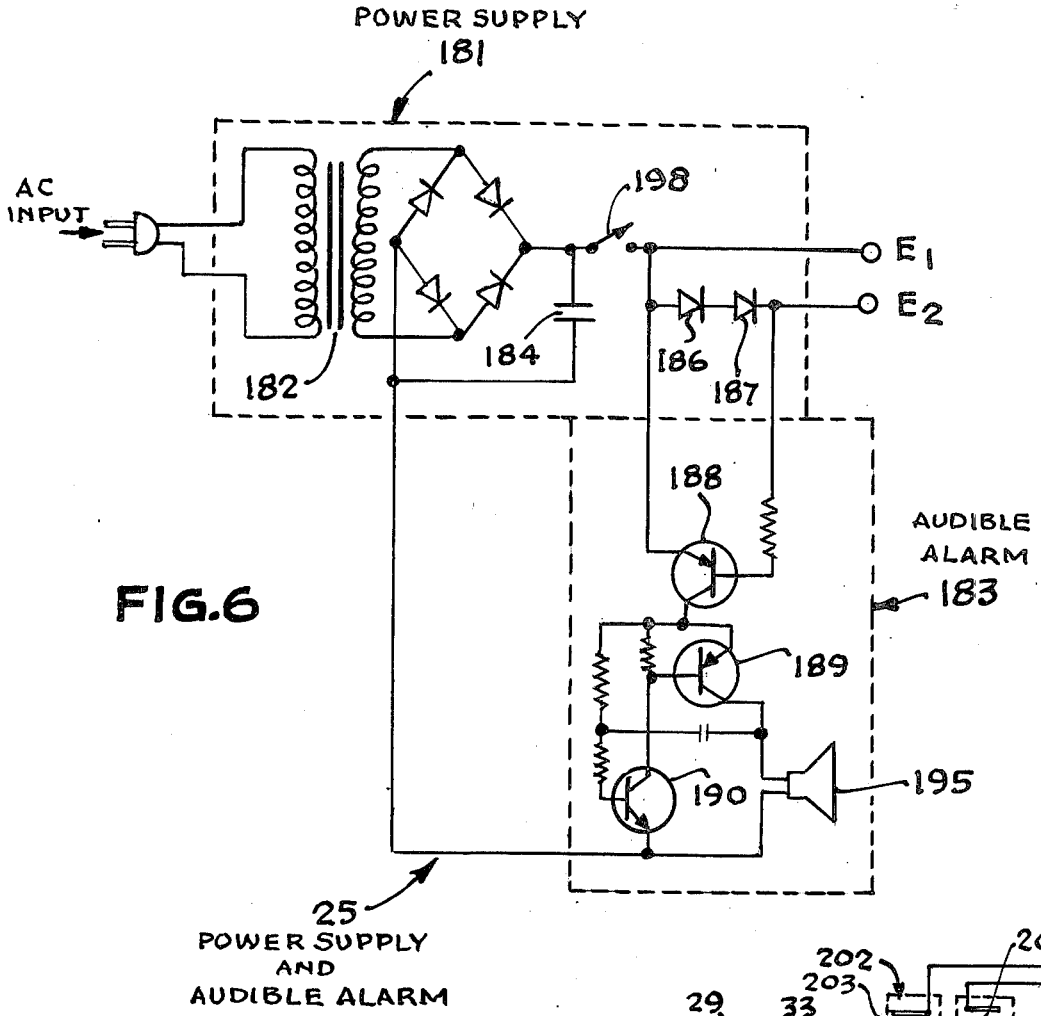
FIG.6
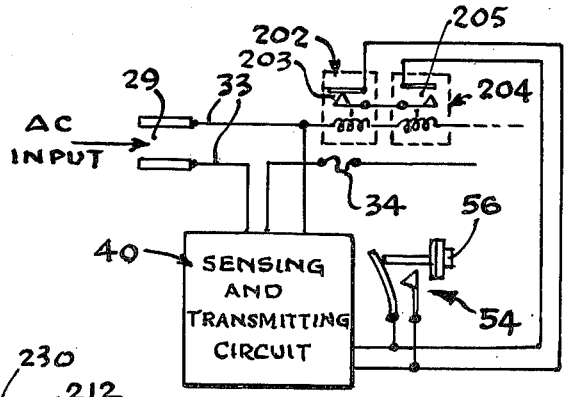
FIG.7
FIG.8
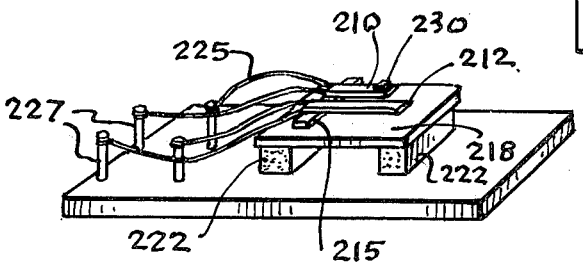

CARRIER CURRENT APPLIANCE THEFT ALARM

BACKGROUND OF THE INVENTION

The present invention relates generally to improved means and methods for monitoring events occuring at one or more of a plurality of remote locations. More particularly, the present invention relates to means and methods for protecting against the unauthorized removal of a remotely located appliance, such as a television set located in a motel or hotel room.

It is customary in hotels and motels to provide a television set in each room for the entertainment of guests. In recent years, television sets have become smaller and more portable. Theft of a television set has thus become easier, particularly in those motels and hotels where it is difficult to monitor or control what is removed from a room by a guest or by a burglar.

There are various possible approaches already known in the art for protecting a TV set or other appliance from unauthorized removal. However, these known approaches are either too expensive and/or complex, or else are too easily defeatable and/or unreliable.

BRIEF SUMMARY OF THE INVENTION

In accordance with the present invention, improved means and methods are provided for protecting against the theft of a remotely located appliance, such as a TV set.

In a preferred embodiment of the invention an improved system is disclosed which can be provided at relatively low cost, requires no modification of the TV set, requires only a simply installable room unit for each room having a TV set which is to be protected, permits the use of existing power and telephone lines customarily provided for the motel or hotel, and protects against the most common attempts which might be used to steal the TV set.

In a preferred embodiment in accordance with the invention, each guest room is provided with a room unit which plugs into a conventional duplex AC power socket already contained within the room. The unit is readily installed to this conventional duplex socket by removing the existing cover plate and replacing it with the room unit. The room unit cover plate is coupled to a switch provided within the room unit which is actuated when the cover plate is removed so as to thereby indicate tampering.

The room unit is powered by the AC input of the conventional duplex socket and requires a minimum of standby power for its operation, regardless of whether the TV set is on or off. The room unit includes sensing means which are not only able to sense removal of the TV power cord plug, but also are able to sense when any portion of the television power cord is cut at any location between the plug and the TV set, whether the TV set is on or off. The room unit additionally includes highly stable and reliable transmitting and modulation means for coupling an audio modulated RF signal back to the input AC power line in response to the sensing of a condition indicating an attempted theft of the TV set, such as removal of the room unit cover plate, cutting of the TV set power cord, or an attempt to short out the socket. Each room unit is provided with a unique audio modulating frequency so as to permit identification of the room which is signalling.

In the preferred embodiment of the invention disclosed, receiving means are preferably provided at the AC power source location of the hotel or motel for receiving and demodulating the audio modulated RF signals transmitted from the room units. It is of advantage to locate the receiving means at the AC power source location in order to permit the receiving means to receive the audio modulated RF signals directly from the AC power lines connected to the room units without having to be concerned with the complicating effects of transformers and other AC power line devices which are normally present in the AC wiring system customarily provided for motels and hotels. This location of the receiving means ordinarily does not require the provision of additional wiring since spare telephone lines are usually available in a motel or hotel running from the power source location to a desired monitoring location, such as the registration desk. In the preferred embodiment of the invention disclosed herein, advantage is preferably taken of such telephone lines for feeding the audio signals extracted by the receiving means to the monitoring location.

Additional advantage and features of the disclosed preferred embodiment of the invention reside in the manner in which advantageous use is made of a conventional three phase AC power source and wiring system, such as is conventionally provided for supplying AC power to rooms in a motel or hotel.

Further novel and advantageous features reside in the particular preferred circuitry employed for various portions of the system. More particularly, in a preferred embodiment of the invention, novel sensing means are employed in each room unit capable of providing high sensitivity as well as minimum power drain. Also, a novel piezoelectric vibrating reed system is disclosed which may advantageously be used as a filter as well as for the frequency controlling elements of an oscillator, whereby high stability and reliability of system operation are achieved.

Still further features of the invention reside in the manner in which display and alarm means are provided at a central monitoring location for indicating when a particular room is signalling that an unauthorized removal of a TV set is being attempted.

Other objects, aspects, features, advantages and uses of the invention will become evident from the following description of preferred embodiments of the invention taken in conjunction with the accompanying drawings. Although these preferred embodiments are specifically directed to a television theft detection system for use in a hotel or motel, it is to be understood that the various features of the invention disclosed herein are also applicable to a wide variety of other circuits and systems.

BRIEF DESCRIPTION OF THE DRAWINGS

FIG. 1 is an overall block diagram of a preferred embodiment of a theft detection system in accordance with the invention.

FIG. 2 is a schematic representation of a preferred embodiment of a room unit for use in the system of FIG. 1.

FIG. 6 is an electrical circuit diagram of a preferred embodiment of the power supply and audible alarm illustrated in the system of FIG. 1.

FIG. 7 is a fragmentary circuit diagram of a modified room unit containing additional means for use in detecting an attempted theft of a TV set.

FIG. 8 is a pictorial representation of the construction and arrangement of a preferred embodiment of a piezoelectric vibrating read device in accordance with the invention.

Like numerals refer to like elements throughout the figures of the drawings.

DETAILED DESCRIPTION OF THE INVENTION

Figure 3:
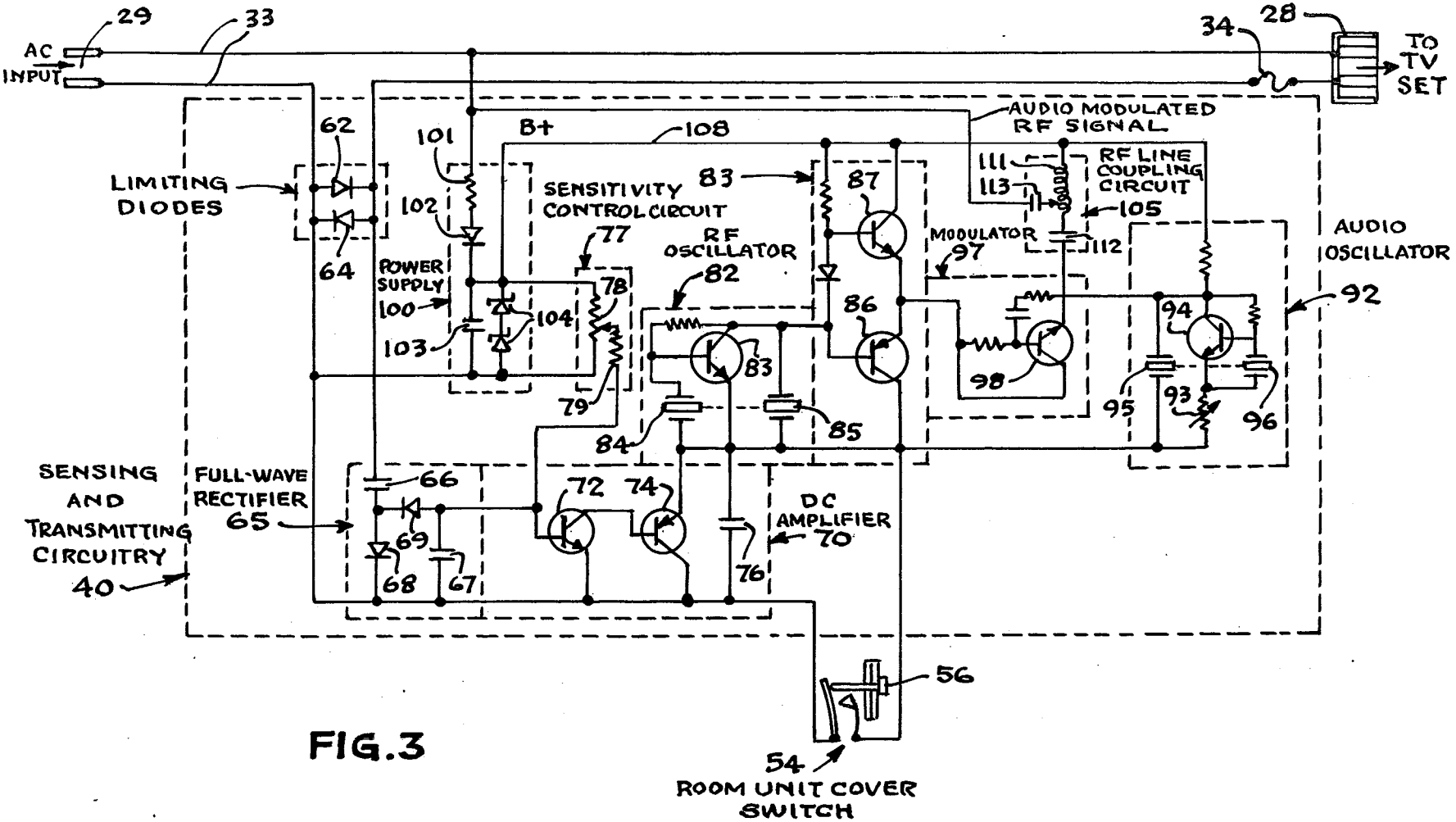
FIG. 3 is an electrical circuit diagram illustrating a preferred embodiment of the sensing and transmitting circuitry employed in the room unit of FIG. 2.

Referring initially to FIG. 1 illustrated therein is an overall block diagram of a preferred embodiment of a television theft detection system in accordance with the invention. A hotel or motel may typically have a three phase AC power source 11 for supplying power to the guest rooms via circuit breakers 12 and respective power lines 13. The circuit breakers 12 and three phase AC power source 10 are normally provided at a common location from which the AC power lines are fed to the various room units. The rooms are connected to the power lines 13 so that the load is fairly equally distributed between the phases.

For the purposes of the present invention, each room containing a TV set to be protected is provided with a room unit 10 which plugs into a standard AC duplex wall outlet normally provided in the room. This AC duplex wall outlet is connected to an AC power line 13 in the normal manner, so that there is no special installation required in a room except to install the room unit 10, which is readily accomplished, as will hereinafter become evident when the preferred embodiment of a room unit 10 shown in FIG. 2 is considered.

Still with reference to the overall system shown in FIG. 1, each room unit 10 is capable of sensing the occurrence of one or more conditions indicative of an attempt at an unauthorized removal of a television set located in the room. In response to sensing the occurrence of such a condition, the room unit 10 transmits an audio modulated RF signal, via its AC power line 13, to a corresponding receiver 16 located at the same location as the three phase AC power source 11. Each phase operates using a different RF frequency and the audio modulation frequency is unique for each room unit 10 connected to the same phase.

Each phase of the AC power source 11 may typically be connected to 20 rooms and the corresponding 20 room units 10 for each phase may provide RF signals with audio modulating frequencies typically ranging from 300 to 3,000 hertz. The three RF carrier signals respectively chosen for the three phases may typically range in frequency from 20 to 100 kilohertz. In an exemplary three phase system, the three RF carrier frequencies may typically be chosen as 30 kilohertz, 60 kilohertz and 90 kilohertz. Because the separate phases form a natural barrier, the transmission of RF signals between phases is small so that the RF carriers may be chosen closer in frequency than would otherwise be possible. Although the frequencies of the three RF carrier signals exemplified above are chosen 30 kilohertz apart for greater isolation, it has been found that, because of the isolation provided by the phases, the frequency separation between RF carriers could be chosen as small as 10 kilohertz and still obtain successful operation.

The isolation made possible by the separation between phases also makes it possible to use the same audio modulating frequencies for the room units of different phases. Thus, in an exemplary system having 20 room units connected to each phase, the twenty audio modulating frequencies which may be respectively used for the twenty room units of each phase may be chosen to have the following audio modulating frequencies: 390 hertz, 450 hertz, 510 hertz, 570 hertz, 630 hertz, 690 hertz, 750 hertz, 810 hertz, 870 hertz, 990 hertz, 1110 hertz, 1230 hertz, 1350 hertz, 1490 hertz, 1640 hertz, 1800 hertz, 2000 hertz, 2200 hertz, 2420 hertz and 2660 hertz. It will be noted that, for greater system reliability, these illustrative audio modulating frequencies have been chosen so that they fall mid-way between the harmonics of the 60 hertz power line frequency. Such a selection is of particular advantage in the lower frequency range where disturbances are more likely.

Continuing with the description of the overall block diagram of FIG. 1 it will be understood that each receiver 16 may typically plug directly into a socket (not shown) provided in its respective circuit breaker 12, or else be connected just ahead of its respective circuit breaker as illustrated. Each receiver 16 is tuned to the RF carrier frequency of its respective phase and operates to demodulate any audio modulated RF signal received from a room unit 10 connected to the same phase, the frequency of the resulting detected audio signal being indicative of the particular room unit 10 from which the RF signal was transmitted.

As mentioned previously, the provision of the receivers 16 at the same location as the three phase AC power source 11 and the circuit breakers 12 is advantageous from the viewpoint of avoiding the added difficulties which would be involved in attempting to reliably receive the transmitted RF signals via transformers and other AC power line devices which would ordinarily be interposed if the receivers 16 were otherwise located. However, although the power source location is advantageous for the greatest reliability in receiving the RF signals transmitted from the room units 10, it is ordinarily not desirable for monitoring purposes. It would be much more desirable to provide for monitoring of the rooms at a location such as the registration desk of the hotel or motel, where personnel are normally present. Fortunately, most hotels and motels have spare telephone lines available running from the general location of the AC power source 11 to the registration desk. In the preferred embodiment of the present invention illustrated in FIG. 1, these spare telephone lines, indicated by the number 18, are advantageously employed for feeding the detected audio signals from the receivers 16 to a desired central monitoring location, such as the registration desk, at which a plurality of display modules 19 are provided, one for each of the room units 10 to be monitored by the system.

Thus, in a three phase system with 20 room units connected to each phase, each receiver 16 will feed its detected audio signals to 20 display modules 19. Each display module 19 is responsive to only the particular audio frequency corresponding to its respective room unit 10. Accordingly, when an audio signal is received by a display module 19 having a frequency corresponding to its respective room unit 10, it will then operate to light an associated lamp **19*a*. The lamps 19*a* may typically be provided on an appropriate display board so as to be visible to an individual at the registration desk. A power supply and audible alarm unit 25 is also provided in the vicinity of the registration desk for supplying power to the room display modules 19**, and also for providing an audible alarm when any lamp is lighted.

Referring next to FIG. 2, illustrated therein is a preferred construction of a typical room unit 10 which is installed in each room having a TV set to be protected. This room unit 10 constitutes the total apparatus which need be installed in each room in accordance with the preferred embodiment of the system being described. The room unit 10 basically comprises a housing 26 having a cover 27 containing a pair of conventional AC socket outlets 28 at the right end (as viewed in FIG. 2) and a pair of standard AC plugs 29 at the left end of the housing. The plugs 29 are adapted to be plugged into one of the standard duplex AC wall outlets (not shown) provided in the room. In order to prevent the plugs 29 of the room unit 10 from being pulled out of the standart duplex AC wall outlet, the room unit 10 is provided with a hole 30 coincident with the location of the hole in the ornamental cover of the standard AC wall outlet. Thus, installation of the room unit 10 merely requires removing of the screw holding the ornamental cover of the standard duplex AC wall outlet, plugging of the room unit plugs 39 into the sockets of the standard duplex AC wall outlets, passing of the removed screw 36 through the hole 30 provided in the room unit, and then threading of the screw 36 back into the threaded hole in the standard AC wall outlet from which it was removed.

It will be seen in FIG. 2 that the contacts of the lower plug 29 are connected via lines 31 to the contacts of the lower outlet 28 with a fuse 32 being inserted in one of the lines 31. This lower outlet 28 is provided for use as a normal AC outlet into which other electrical apparatus may be plugged, such as a vacuum cleaner used by the maid. The fuse 32 is provided in order to protect against a thief shorting the socket and blowing the corresponding circuit breaker 12 (FIG. 1) in an attempt to prevent operation of the room unit 10. The fuse 32 is thus chosen of a value such that it will blow before the circuit breaker 12 opens.

The upper socket 28 of the room unit 10 of FIG. 2 is the one into which the power cord 51 of the TV set 50 which is to be protected is plugged. For reasons which will become evident hereinafter, it is merely necessary that the TV set 50 be plugged into the outlet 28 in the usual manner in order to be protected by the system. There is no need for any additional apparatus to be provided in or on the TV set, nor need there be any modification made in the TV set 50 or in its plug 51, power cord 50, or antenna or antenna connection.

As shown in FIG. 2, the contacts of the upper plug 29 are connected to the contacts of the upper socket 28 via lines 33 with a fuse 34 being connected in series with one of the lines 33. The sensing and transmitting circuitry 40 is preferably provided on a conventional printed circuit board suitably mounted within the housing 26. The fuse 34 serves the same function for the upper socket 28 as does the fuse 32 for the lower socket 28, that is, to prevent blowing of the corresponding circuit breaker 12 (FIG. 1) when the socket 28 is shorted. As will hereinafter become evident, the blowing of the fuse 34 will be sensed by the sensing and transmitting circuitry 40 to cause it to transmit an alarm signal to the central monitoring location via its receiver 16 (FIG. 1).

Still with reference to FIG. 2, it will be noted that the housing 26 of the room unit 10 also includes a normally closed switch 54 which is held in the open condition by a screw 56 which is also used to secure a cover plate 27 on the housing 26 of the room unit 10. If the screw 56 is removed in an attempt to take off the cover plate 27, the switch 54 will close and thereby provide an appropriate indication to the sensing and transmitting circuitry 40 that someone is improperly tampering with the room unit 10.

Before considering the detailed preferred embodiment of the sensing and transmitting circuitry 40 shown in FIG. 3, it will be helpful to first note with reference to FIG. 2 the particular conditions which this preferred circuitry 40 is designed to sense. These conditions are as follows: (1) blowing of the fuse 34; (2) removing of the room unit cover; (3) removing of the TV plug 51; and (4) cutting of the TV power cord 52 at any point between the plug 51 and the TV set 50 whether the TV set is on or off. It is to be understood that although the sensing of these particular conditions is preferred in the illustrative embodiment presently being described, the invention is not be be considered as either requiring or being limited to the sensing of these conditions.

It will be recognized that the most difficult of the above three conditions to sense is the cutting of the TV power cord 52 when the TV set 50 is off, since for this condition, only a very small current will flow in the TV power cord. This very small current is determined by the power cord impedance, which is primarily capacitive and may typically be of the order of 100 to 300 picofarads. Furthermore, cutting the power cord near the entry point to the TV set may typically result in only a 10% change in the current flowing in the power cord when the TV set is off. Thus, a change in power cord capacitance of only about 10 to 30 picofarads will have to be sensed if the TV set is to be protected against such a cutting of its power cord. Although the reliable detection of a change of this small magnitude is difficult, it is nevertheless important that the system provide such a capability, since the cutting of the TV power cord is one of the most common ways that a TV set is stolen, particularly by a burglar who wishes to remain in the room for as short a time as possible. Furthermore, prior art theft detection systems typically protect only against removal of the TV power cord, so that a thief who has some knowledge of prior art systems may believe that cutting of the TV power cord with the TV set off would not be detected by any theft detection system which may be present.

It will now be described with reference to the preferred circuitry illustrated in FIG. 3 how the sensing and transmitting circuitry 40 provides for sensing of the cutting of the TV power cord 52 (FIG. 2) when the set is off as well as on, and also provides for the sensing of the other conditions set out above, all of these being accomplished with minimum power drain and relatively simple and economic circuitry. Also to be described is the manner in which the preferred circuitry 40 shown in FIG. 3 provides for the transmission, via its respective AC power lines 13 (FIG. 1), of a highly stable audio modulated RF signal in response to the sensing of any of these conditions.

Thus, referring to FIG. 3, it will be noted that the input plug, 29, the lines 33, the fuse 34, the cover switch 54 and the upper socket 28 are included in FIG. 3 along with the sensing and transmitting circuitry 40 for ready comparison with FIG. 2. Directly across the input of the sensing and transmitting circuitry 40 is provided a pair of parallel, oppositely poled limiting diodes 62 and 64 which are in series with the lower input line 33. Preferably, the diodes 62 and 64 are semiconductor, silicon power rectifier diodes. Such a diode typically has a high resistance in the back direction, and also initially has a high resistance in the forward direction until a threshold voltage of typically 0.6 volts is reached, after which the forward resistance becomes very small so that the voltage across the diodes remains essentially at this threshold value of 0.6 volts regardless of the current flowing through the diode. Thus, it will be understood that the parallel oppositely poled diodes 62 and 64 serve to limit the maximum voltage of either polarity which can appear across the sensing and transmitting circuitry 40 to an appropriate small value, even with the TV set turned on. Furthermore, these diodes 62 and 64 have a negligible effect on the operation of the TV set and consume negligible power even when the TV set is on.

As pointed out previously, when the TV set is off, the current flowing to the TV power cord via the input lines 33 is determined by the impedance of the TV power cord, which is primarily capacitive. For the usual TV power cord, this current is so small that the diodes 62 and 64 will be in their below threshold region. Thus, the diodes 62 and 64 will present a high impedance and thereby permit even the small current flowing in lines 33 when the TV set is off to cause a full wave rectifier 65 connected across diodes 62 and 64 to produce a negative DC output voltage of typically 80 millivolts for maintaining a high input impedance DC amplifier 70 in an off or non-conducting state.

The full wave rectifier 65 in FIG. 3 may typically comprise capacitors 66 and 67 and diodes 68 and 69 connected in a conventional manner to provide full wave rectifier operation, as shown. The capacitors 66 and 67 may each typically have a value of one microfarad. The diodes 68 and 69 are preferably signal-type diodes having a sharp knee and a very low resistance in the forward direction when conducting. It has been found that the nature of the operation of the full wave rectifier 65 is such that it advantageously provides a delay which prevents a too rapid change in its output voltage, thereby preventing line transients or other intermittent changes of negligible duration from being fed to the DC amplifier 70. The amount of delay may be controlled by varying the values of the capacitors 66 and 67. The DC amplifier 70 typically comprises an NPN transistor 72 whose output is directly coupled to a PNP transistor 74. In operation, these transistors 72 and 74 remain cut off so long as the negative output voltage applied to the base of the input transistor 72 from the full wave rectifier 65 is above a predetermined minimum value which is chosen to be indicative of the presence of the full length of the TV power cord.

In order to accomodate an appropriate range of TV power cord impedances, a sensitivity control circuit 77 is provided for applying an adjustable positive bias to the base of the input transistor 72 to permit adjustment of the particular full wave rectifier output voltage which will cause the DC amplifier 70 to be turned on. It will be understood that a wide range of TV power cord impedances can thus be accomodated by adjusting the sensitivity control circuit 77 so that the particular negative rectifier output voltage produced by a given TV power cord when the TV set is off is sufficient to reliably maintain the DC amplifier 70 non-conducting. Of course, when the TV set is on, the rectifier output voltage will be considerably higher and more than adequate to maintain the DC amplifier 70 cut off, the maximum rectifier output voltage being limited by the limiting diodes 62 and 64 as explained previously.

It has been found that the length of power cord provided within the usual TV set is long enough so that, even if the power cord is cut at its point of entry into the TV set, a sufficient reduction is obtained in the rectifier output voltage when the TV set is off to reliably turn on the DC amplifier 70. In the rare case where a particular TV power cord is of inappropriate length, and/or if an insufficient change in power cord impedance would occur if the TV power cord were cut at its point of entry into the TV set, the situation can be remedied simply by changing the length of the TV power cord outside and/or inside of the TV set.

Continuing with the description of the preferred circuitry of FIG. 3, DC power of typically 22 volts is provided for the sensing and transmitting circuitry 40 of FIG. 3 by connecting the AC input lines 33 to a conventional power supply 100 comprising a dropping resistor 101, a rectifying diode 102, a filter capacitor 103, and series connected zener diodes 104 connected across the filter capacitor 103 for regulating purposes. The sensitivity control circuit 77 typically comprises a potentiometer 78 connected across the power supply 100 with a resistor 79 of typically one megohm being inserted in series with the variable arm of the potentiometer 78 to maintain the high input impedance of the DC amplifier transistor 72 when connected to the base thereof.

So far, the description of FIG. 3 has been primarily concerned with the manner in which the circuit 40 provides for the most difficult to sense condition of cutting of the TV power cord when the TV set is off. However, it will readily be evident that either blowing of the fuse 34, or removal of the TV set from the socket 28, will also cause the DC amplifier 70 to be turned on, since the occurence of either condition will cause the rectifier output voltage to fall to essentially zero. Also, it will be noted that the room unit cover switch 54 is connected across the output of the DC amplifier 70. Thus, if the screw 56 is sufficiently loosened in an attempt to remove the room unit cover, the switch 54 will close and thereby have the same effect as the turning on of the DC amplifier 70.

Next to be considered with reference to FIG. 3 is the manner in which the turning on of the DC amplifier 70 in response to cutting of the TV power cord, blowing of the fuse 34, or removal of the TV plug from the socket 28, or the closing of the room unit cover switch 54, causes the transmitting portions of the circuit 40 to generate an audio modulated RF signal for transmission to its respective receiver 16 (FIG. 1) via the AC power lines 33. In order to provide for generation of this audio modulated RF signal and coupling thereof to the AC power lines 33, the transmission portions of the circuit 40 of FIG. 3 include: an RF oscillator 82 for providing an RF signal at a frequency corresponding to the particular phase to which the room unit 10 is connected, an RF driver 85 for amplifying the RF signal produced by the RF oscillator 82 to an appropriate power level, an audio oscillator 92 for providing an audio signal at the particular identifying audio frequency assigned to the room unit, a modulator 97 for amplitude modulating the amplified RF signal from the RF driver in accordance with the audio signal produced by the audio oscillator 92, and an RF line coupling circuit 105 for coupling the resulting audio modulated RF signal to the power lines 33 for transmission to the corresponding receiver 16 (FIG. 1). The circuit 40 of FIG. 3 provides for maintaining these transmitting portions inactivated until turning on of the DC amplifier 70 or closing of the room unit cover switch 54, in a particularly advantageous manner. The basic approach employed is to power these transmitting portions through the DC amplifier 70. In other words, the DC amplifier 70 is connected in series with the power supply 100 with respect to these transmitting portions so that they can receive their required DC powering only when the DC amplifier 70 is turned on, or the cover switch 54 is closed. More specifically, it will be understood that the power supply 100 supplies the DC current required for these transmitting portions via line 108, and that this DC current must ultimately flow through the DC amplifier 70 or the cover switch 54 in order to return to the other side of the power supply 100. An additional advantage of this powering arrangement is that the standby power required for the room units 10 is very small. A capacitor 76 is connected across the output of the DC amplifier 70 to provide a low impedance AC bypass.

The preferred curcuits illustrated in FIG. 3 for the transmitting portion of the circuitry 40 will now be considered in more detail. The RF oscillator 82 comprises an NPN transistor 83 connected in a conventional manner to the strips or reeds 84 and 85 of a vibrating reed system tuned to the desired RF frequency while the audio oscillator 92 comprises an NPN transistor 94 connected in conventional manner to the reeds or strips 95 and 96 of a vibrating reed system tuned to the desired audio frequency. It will be understood that the use of a vibrating reed system as the frequency controlling elements for the RF and audio oscillators 82 and 92 permits the generation of highly stable RF and audio signals which can be accurately and sharply tuned as required for reliable operation of the system. A particularly advantageous embodiment of a vibrating reed system for use in the oscillators 82 and 92 will hereinafter be described with reference to FIG. 8.

Considering now the RF driver 83 in FIG. 3, it will be seen to comprise a PNP transistor 86 and an NPN transistor 87 connected as a complementary pair so as to provide push-pull power amplification of the RF signal applied thereto from the RF oscillator 82. The RF driver 85 provides a low output impedance for driving the modulator 97. This low output impedance also serves to buffer any power line impedance variations or heavy transients impinging on the RF line coupling circuit 105. The modulator 97, includes an NPN transistor 98 connected to the RF driver 83 and audio oscillator 92 so as to operate as a variable impedance in the output circuit of the RF driver 85, which impedance varies in accordance with the audio signal. A variable emitter resistor 93 is provided in the audio oscillator 92 for adjusting the percentage of modulation provided by the audio signal.

The resulting audio modulated RF signal is applied to the RF line coupling circuit 105 which comprises a series connected coil 111 and capacitor 112 tuned to the RF frequency, and a line coupling capacitor 113 connected between a tap on the coil 111 and the input line 33. The line coupling circuit 105 is tuned sufficiently sharply to suppress any harmonics of the RF oscillator signal while still providing sufficient bandwidth to accomodate the modulation components of the audio modulated RF signal.

Figure 4:
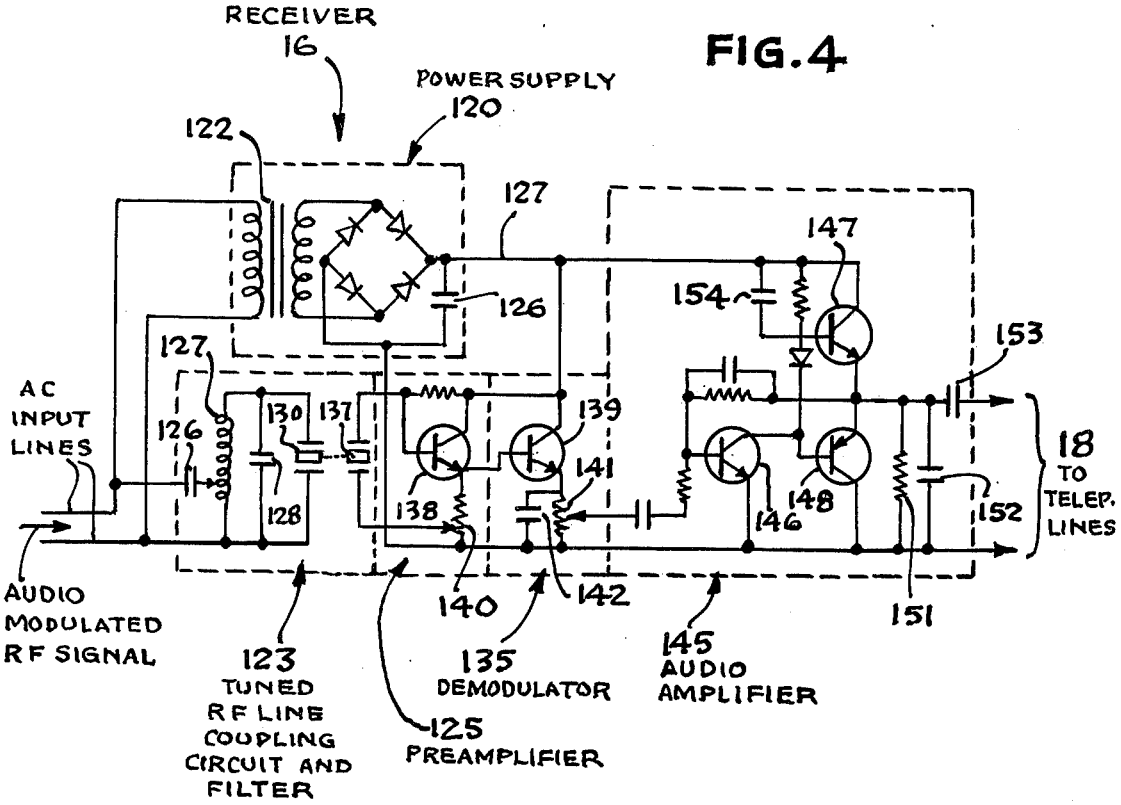
FIG. 4 is an electrical circuit diagram illustrating a preferred embodiment of a receiver for use in the system of FIG. 1.

Referring next to FIG. 4, illustrated therein is a preferred embodiment of one of the receivers 16 illustrated in FIG. 1. As pointed out in connection with the overall diagram of FIG. 1, each receiver 16 is connected to a respective phase of the three phase AC power lines 13, and is most preferably located at the same location as the AC power source 11. Each receiver preferably includes its own power supply 120 derived from the AC input lines in a conventional manner. Typically, the power supply 120 includes a transformer 122 feeding a full wave diode rectifier which, in turn, feeds a filter capacitor 126 for producing a DC voltage on the power supply output line 127 for powering the receiver circuitry.

The AC input lines of the receiver 16 also contain any audio modulated RF signal transmitted by a corresponding room unit 10 of the same phase. This modulated RF signal is applied to a preamplifier 125 in the receiver of FIG. 4 via a tuned RF line coupling and filter circuit 123 tuned to the RF frequency corresponding to the respective phase to which the receiver is connected. The amplified RF output from the preamplifier 125 is applied to a demodulator or detector 135 which extracts the audio signal from the audio modulated RF signal, and then applies the detected audio signal to an audio power amplifier 145 which, in turn, feeds the amplified detected audio signal to its corresponding telephone line 18 for transmission to the central monitoring location.

The preferred circuitry for the receiver 16 illustrated in FIG. 4 will now be considered in more detail. The tuned RF line coupling and filter circuit 123 includes a line coupling capacitor 126, a coil 127 and tuning capacitor 128 in parallel, and a tuned vibrating reed system comprised of mechanically coupled reeds or strips 130 and 137. A particularly advantageous embodiment for such a vibrating reed system is illustrated in FIG. 8 and will hereinafter be considered in detail. The vibrating reed system is tuned in conjunction with the coil 127 and capacitor 128 to the desired RF frequency of the receiver with a sufficient bandwidth being provided to accomodate the modulation components of an audio modulated RF signal received from any of the corresponding room units. The use of the tuned vibrating reed system is advantageous because it permits obtaining a flat-topped pass band with extremely steep skirts. Also, the vibrating reed system has the advantage of providing good electrical isolation between the AC input lines and the remaining portions of the receiver circuitry.

The preamplifier 125 in FIG. 4 typically comprises an NPN transistor 138 connected as an emitter follower amplifier with a potentiometer 140 being connected in the emitter circuit to provide a gain control adjustment. The output of the preamplifier 125 is applied to a demodulator 135 comprising an NPN transistor 139 in a common emitter connection. A potentiometer 141 and a parallel capacitor 142 are connected in the emitter circuit of the transistor 139 to provide a low pass filter for extracting the audio signal, which is then applied to the audio amplifier 145. The audio amplifier 145 typically comprises an NPN input transistor 146 feeding an NPN transistor 147 and a PNP transistor 148 connected as a complementary pair to provide push-pull audio power amplification of the detected audio signal. The resulting amplified audio signal is fed to the telephone lines 18 via a low pass filter circuit comprised of a parallel resistor 151 and capacitor 152, and a series capacitor 153 which serves to filter out low frequency transients. A capacitor 154 is provided in the input circuit of the complementary transistors 147 and 148 for a like purpose.

Figure 5:
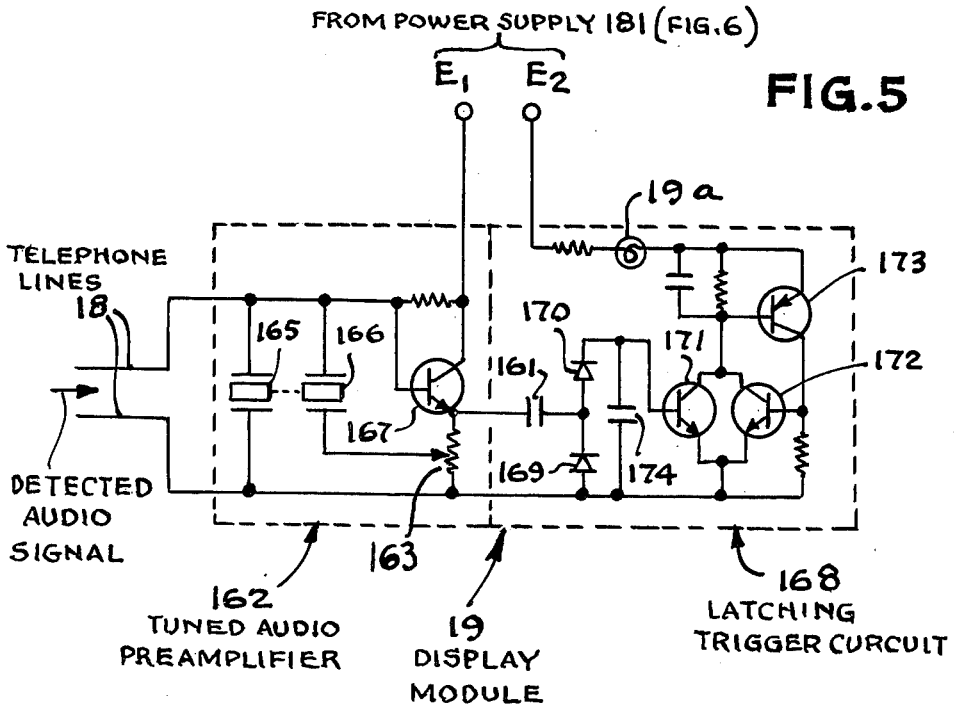
FIG. 5 is an electrical circuit diagram illustrating a preferred embodiment of a display module for use in the system of FIG. 1.

Referring next to FIG. 5, illustrated therein is a preferred embodiment of one of the room display modules 19 illustrated in FIG. 1. The detected audio signal received on telephone lines 18 is first applied to a tuned audio preamplifier 162 whose input is sharply tuned to the corresponding room unit audio frequency by mechanically coupled reads or strips 165 and 166. This vibrating reed system may be similar to that employed for the room unit audio oscillator 92 shown in FIG. 3 and a particularly advantageous embodiment thereof is illustrated in FIG. 8. An NPN transistor 167 connected as an emitter follower amplifier receives the output from the vibrating reed system 165,166. The output of the preamplifier 162 is applied to a latching trigger circuit 168 which operates in response to the receipt of a corresponding audio frequency by the preamplifier 162 to turn on the lamp **19*a* to indicate that the corresponding room unit is transmitting an alarm signal. Once triggered, the latching trigger circuit 168 remains latched to keep the lamp 19*a* on until unlatched by a switch 198 in the power supply 181 (FIG. 6). A potentiometer 163 is connected in the emitter circuit of the preamplifier transistor 167 to provide a sensitivity control for the latching trigger circuit 168**.

The latching trigger circuit 168 in FIG. 5 typically includes a conventional full wave rectifier comprised of capacitors 161 and 174 and diodes 169 and 170 connected in a conventional manner to produce a positive DC output signal across the capacitor 174 in response to an audio signal from the preamplifier 162. The latching trigger circuit 168 also includes NPN transistors 171 and 172 and a PNP transistor 173 connected in a conventional manner to operate as a latching regenerative switch in response to the positive DC output signal produced across capacitor 174. Power for the display module 19 is provided by DC voltages $E_1$ and $E_2$ obtained from the power supply 181 in FIG. 6.

Referring next to FIG. 6, illustrated therein is a preferred embodiment of the power supply and audible alarm 25 illustrated in FIG. 1, and which may be plugged into a standard AC outlet at the central monitoring location. A power supply 181 is provided in a conventional manner by feeding the AC input to a transformer 182 whose output is in turn fed via a diode full wave rectifier to a filter capacitor 184 for producing the desired DC voltage. As mentioned in connection with the description of the display module 19 of FIG. 5, a switch 198 is provided in series with the output from the power supply 181 to provide for unlatching of any of the display modules **19*a* which may have become latched in response to the receipt of an alarm signal from its corresponding room unit. When the switch 198 is opened, it removes the power applied to the modules by voltages $E_1$ and $E_2$ so as to unlatch and thereby turn off the lamp 19*a* of any display module 19** which may have been latched.

Considering now the preferred embodiment of the audible alarm 183 illustrated in FIG. 6, it will be noted that diodes 186 and 187 are inserted in series with the output voltage $E_2$ of the power supply 181 for providing an input signal to the audible alarm 183. The use of these diodes 186 and 187 is advantageous in that they produce only a negligible voltage drop so as to not interfere with the operation of the latching trigger circuit 168 of FIG. 5 while providing a convenient input signal for the audible alarm 183 in FIG. 6. When the latching trigger circuit 168 of FIG. 5 turns on, the current flowing through these diodes 186 and 187 provides a voltage input signal which is amplified by an amplifier comprised of PNP transistors 188 and 189 and NPN transistor 190 so as to thereby produce a resulting signal of sufficient amplitude for driving an audible alarm, such as a speaker 195.

It is to be noted that the power supply and audible alarm 25 illustrated in FIG. 6 offers the advantage of requiring only a minimum of standby power since the power supply 181 need supply only the relatively small current required for the preamplifier 162 in the display modules 19 in the standby condition. The latching trigger circuit 168 and the lamp **19*a* draw no current until triggered in response to a detected audio signal. Also, the audible alarm 183 in FIG. 6 will likewise draw no current in the standby condition since it will not be actuated unless a lamp 19*a* in a display module 19 is turned on. Furthermore, since it can be expected that only one or two of the modules 19 might be turned on at any one time, the power supply 181 can be designed to provide only the required current for the relatively small number of modules 19** which in the worst case condition might be on at the same time.

Referring next to FIG. 7, illustrated therein is a modification of the room unit 10 of FIG. 2 for providing further protection against an attempt to defeat the system. More specifically, it will be seen that relays 202 and 204 have been inserted in series with the AC input lines 33, the relay 202 including a pair of normally closed contacts 203 which are opened when the relay 202 is actuated, and the relay 204 including a pair of normally open contacts 205 which are closed when the relay 204 is actuated. The contacts 203 and 205 are connected in series with each and in parallel with the room cover switch 54, as shown. The relay 202 is typically chosen so that it is relatively fast acting and requires a relatively large current for actuation so that it will only be actuated when the TV set is turned on and will not be actuated by any significantly lower current. The relay 204 on the other hand, is typically chosen so that it requires a relatively small current for actuation which is greater than the current normally flowing in the AC input lines 33 when the TV set is off, but which current is less than the current required for actuation of the relay 202.

It will thus be understood with respect to the modified room unit of FIG. 7, that both of the relays 202 and 204 will be actuated when the TV set is on, while neither of the relays 202 and 204 will be actuated when the TV set is off. In either case, there will be no resulting effect on the operation of the sensing and transmitting circuitry 40, since at least one of the series-connected relay contacts 203 or 205 will be open. In order to prevent the contacts 205 of relay 204 closing before the contacts 203 of relay 202 open, the relay 204 is preferably chosen of a type requiring an appropriately longer time for actuation. Thus, if a thief in an attempt to defeat the system, tampers with the TV power cord on the TV set so as to cause a larger than normal current to flow in the input lines 33 which is not sufficient to actuate the relay 202, but which is sufficient to actuate the relay 204, then both of the series-connected relay contacts 203 and 205 will be closed, and thereby cause the room unit to transmit an alarm signal in the same manner as occurs when the room unit cover switch 54 is closed.

Although the added relays 202 and 204 illustrated in FIG. 7 are typically of the electromagnet type, it is within the scope of the present invention to provide electronic switching circuits for performing like functions. It will also be understood that such electronic switching circuits may be connected for cooperative operation with other portions of the circuitry 40.

Referring now to FIG. 8, illustrated therein is a particularly advantageous embodiment of a vibrating reed system in accordance with the invention. The basic system preferably comprises first and second parallel strips or reeds 210 and 212 having their ends rigidly affixed to a block or bar 215 which is in turn rigidly mounted to a common mass 218. The reeds 210 and 212 are each tuned to vibrate at a predetermined fundamental frequency, which is usually chosen the same for both reeds. The mechanical coupling between the reeds 210 and 212 is determined primarily by the common mass 218 to which the reeds are coupled via the bar 215. As is well known, the mechanical coupling provided between tuned vibrating reeds is an important factor determining the resulting frequency response characteristic of the system. The bar 215 may typically be an epoxy glass material such as used for printed circuit boards. The reeds 210 and 212 may be secured to the bar 215 by soldering to conductive material provided thereon and/or by use of a suitable epoxy.

The common mass 218 is shock mounted to a suitable supporting base by shock mounting members 222 which may typically be sponge rubber. Such a shock mounting is advantageous in that it prevents shock or vibrations applied to the supporting base from being transmitted to the vibrating reed system, and also serves to make the mechanical coupling between the reeds 210 and 212 independent of the mass of the supporting base.

A particularly advantageous feature of the vibrating reed system illustrated in FIG. 8 resides in the use of piezoelectric elements as the vibrating strips or reeds 210 and 212. When so used, the piezoelectric elements advantageously serve as both the frequency controlling elements as well as the driving and sensing transducers of the system. Typically, the piezoelectric elements used for the reeds 210 and 212 each comprise one or more stacked plates of piezoelectric ceramic material having conductive electrodes on its opposite sides and polarized so that, when bent, a voltage signal is produced on one side which is of opposite polarity to that produced on the other side.

As illustrated in FIG. 8, electrical connections to the conductive electrodes of the piezoelectric reeds 210 and 212 are provided by soldering one end of wires 225 to respective electrodes of the reeds, and the other end of the wires 225 to respective terminals 227 provided in the supporting base, which is typically of insulative material. An example of a suitable piezoelectric material from which the reeds 212 and 214 may be cut is a bimorph piezoelectric sheet material having nickel electrodes and available from Vernitron Piezoelectric Division, Bedford, Ohio under the designation PZT-5H.

Another particularly advantageous feature of the vibrating reed system illustrated in FIG. 8 resides in providing the reeds 210 and 212 so that they are tuned to substantially the same fundamental frequency, but to different harmonic frequencies. A preferred way of accomplishing this purpose is to provide the reeds 210 and 212 of different lengths, as illustrated in FIG. 8, and to employ free end mass loading of the shorter reed 210, such as indicated at 230 in FIG. 8, to tune it to the same fundamental frequency as the longer reed 212. For maximum stability the longer reed 212 is employed as the driving reed of the system and the shorter reed 210 as the sensing reed. The longer reed 212 could also be free end mass loaded for tuning purposes. It is further possible to employ reeds of the same length with different loadings so that they tune to the same fundamental frequency, but to different harmonic frequencies.

In a particular preferred embodiment of the vibrating system of FIG. 8, the reeds 210 and 212 are approximately 0.019 inches thick and 0.065 inches wide with a nickel electrode being provided on each side of typically less than 0.0001 inch. For a 1000 hertz vibrating reed system, such as may be employed in a room unit audio oscillator 92 (FIG. 3) and also in a tuned audio preamplifier 162 of a display module 19 (FIG. 5) the shorter reed 210 is typically approximately 0.65 inch long and the longer reed 212 is typically, approximately 0.75 inch long. Free end mass loading of the shorter reed 212 is typically provided using a suitable epoxy, such as indicated at 230 in FIG. 8 for tuning the shorter reed 210 and 212 to the same fundamental 1,000 hertz frequency as the longer reed. The coupling mass is typically provided empirically by starting with a larger mass than required and cutting it away little by little until two peaks are observed in the frequency characteristic. Mass is then added, such as by adding epoxy at the secured ends of the reeds, until a single sharp resonant peak is obtained at 1,000 hertz.

For an RF vibrating reed system, such as may be employed in the room unit RF oscillator 82 (FIG. 3), and in the tuned RF line coupling circuit and filter 123 of a receiver (FIG. 4) the reeds 210 and 212 may each be typically 1.2 inch long and of the same thickness and width as given above. Appropriate loading of the reeds is then provided so as to tune them to the same desired RF frequency, but to different harmonic frequencies. For the room unit RF oscillator 92 (FIG. 3), the coupling mass is preferably adjusted to provide a sharp resonant peak in a manner similar to that described for the audio vibrating reed system. However, for the tuned RF line coupling and filter 123 of the receiver (FIG. 4), the coupling mass of the RF vibrating reed system is adjusted to provide a flat-topped pass band of sufficient width to accomodate the modulation components of the received audio modulated RF signal.

It will thus now be evident that the vibrating reed system illustrated in FIG. 8 provides an economical and relatively simple construction which is adaptable for use at both audio and RF frequencies, which can readily be adjusted to provide a desired frequency response characteristic, and which also has significantly reduced sensitivity at harmonic frequencies. In addition, it has been found that the particular width and spacing of reeds 210 and 212 as well as the dimensions of the coupling bar 215 are relatively non-critical.

Although the present invention has been disclosed with respect to particular preferred embodiments thereof, it will be understood that the present invention is subject to a wide variety of possible modifications and variations in construction, operation and use thereof within the scope of the invention. Accordingly, the present invention is to be considered as including all such possible variations and modifications coming within the scope of the appended claims.

The embodiments of the invention in which an exclusive property or privilege is claimed are defined as follows:

1. In a monitoring system for monitoring conditions occurring at a large plurality of remote locations, sensing and transmitting means located at each remote location and being operative to sense the occurrence of an undesired condition and in response thereto to transmit a modulated signal, a plurality of receiving means for receiving said modulated signals, each of said receiving means being operative to detect the modulation of a received signal and to produce a detected output signal corresponding thereto, and monitoring means connected to said receiving means and responsive to said detected output signals said monitoring means including a frequency-sensitive indicating means for each remote location tuned to the corresponding modulating frequency thereof, for providing an indication of the corresponding remote location, each of said sensing and transmitting means including an RF oscillator having a tuned reed vibrating system for generating a carrier signal, and an audio oscillator having a tuned vibrating reed system for generating a modulating signal, each of said receiving means including tuned input means having a vibrating reed system tuned to provide a flat-topped pass band, the pass band being centered at the respective carrier frequency and having sufficient bandwidth to accommodate the modulation components of the carrier signal, and each of said frequency-sensitive indicating means including a tuned input circuit having a vibrating reed system sharply tuned to the modulating frequency of its corresponding sensing and transmitting means.

2. The invention in accordance with claim 1, wherein each of said vibrating reed systems includes tuned mechanically coupled vibrating reeds formed of piezoelectric material which serve as the frequency controlling elements as well as the driving and sensing transducers of the system.

3. The invention in accordance with claim 1, wherein at least the said vibrating reed systems provided in said audio oscillator and said frequency-sensitive indicating means include mechanically coupled vibrating reeds constructed and arranged so as to be tuned at different harmonic frequencies.

4. Sensing and transmitting means for use in a theft detection system for protecting against the theft of an electrical device, said sensing and transmitting means comprising:

input means for connecting to the power lines of an AC electrical power source, output means to which said electrical device can be connected via a power cord provided with said device for receiving operating power from said power lines, rectifying means coupled between said input and output means for producing an output voltage dependent upon the impedance of said power cord, limiting means coupled across the input to said rectifying means for limiting the maximum voltage applied thereto, generating means for generating an alarm signal, and means coupling said rectifying means and said generating means so as to cause said generating means to generate said alarm signal in response to said rectified output voltage being reduced below a predetermined minimum value.

5. The invention in accordance with claim 4, wherein said limiting means comprises a pair of parallel, oppositely poled semiconductor diodes in series with one of said power lines and having a threshold voltage above which the voltage remains substantially constant regardless of the magnitude of the current therethrough.

6. The invention in accordance with claim 4, wherein said rectifying means comprises first and second semiconductor diodes and first and second capacitors connected to provide full wave rectificaion of an input voltage applied thereto, said diodes having a sharp knee.

7. The invention in accordance with claim 4, wherein said sensing and transmitting means also includes a sensitivity control means for adjusting said predetermined minimum value so as to accomodate the particular length of power cord provided with said device.

8. The invention in accordance with claim 4, wherein said sensing and transmitting means also includes power supply means which derives its power from said power lines and wherein said means coupling said rectifying means and said generating means operates to cause power to be supplied to said generating means from said power supply when said rectified output voltage is reduced below said predetermined mininum value.

9. The invention in accordance with claim 8, wherein said means coupling said rectifying means and said generating means includes a DC amplifier which is normally non-conducting and becomes conducting in response to said rectified output voltage being reduced below said predetermined minimum value.

10. The invention in accordance with claim 4, wherein said sensing and transmitting means also includes switching means responsive to current flowing to said electrical device for causing said generating means to generate said alarm signal when the current flowing to said device is at a predetermined value chosen to be greater than the current which would normally flow to said device when the device is off, but less than the current which would flow when the device is operating.

11. The invention in accordance with claim 4, wherein said sensing and transmitting means is provided in a housing with a cover secured thereon, and wherein means are provided within said housing for causing said generating means to generate said alarm signal when said cover is removed.

12. The invention in accordance with claim 4, wherein said alarm signal is an audio modulated RF signal which is coupled back to said power lines, and wherein said generating means includes an RF oscillator, an audio oscillator, and a modulator for modulating the RF signal produced by said RF oscillator in accordance with the audio signal produced by said audio oscillator so as to produce said modulated RF signal.

13. The invention in accordance with claim 12, wherein said oscillator includes a tuned vibrating reed system having first and second mechanically coupled reeds.

14. The invention in accordance with claim 13, wherein each reed is comprised of a piezoelectric material which vibrates at the desired oscillation frequency of its respective oscillator and which is polarized so that during vibration of the reed a voltage signal is produced on one side of the reed which is opposite to that produced on the other side of the reed.

15. The invention in accordance with claim 14, wherein the vibrating reed system of at least said audio oscillator is provided with reeds of different lengths with the shorter reed being provided with free end mass loading to tune it to the same audio frequency as the longer reed but to different harmonic frequencies.

16. Monitoring means for use in a system for monitoring conditions occurring at a plurality of remote locations wherein signals of unique frequency are applied to said monitoring means respectively corresponding to the particular remote locations from which the signals are derived, said monitoring means comprising:

a plurality of tuned indicating means, each tuned to a respective frequency of a corresponding remote location and operative to provide an indication of the respective remote location in response to the application thereto of a signal of corresponding frequency, each of said indicating means including a latchable trigger circuit means for providing its indication in a manner so that no power is required until triggering occurs, power supply means for supplying power to said tuned indicating means, impedance means connected in series with said power supply means, power being supplied to the latchable trigger circuit means of all of said indicating means through said impedance means, and alarm means connected to said impedance means and responsive to power supply current flowing therethrough as a result of at least one of said latchable trigger circuit means being triggered for providing said alarm indication.

17. The invention in accordance with claim 16, wherein said impedance means includes at least one semiconductor diode for producing an input signal for said alarm means.

18. The invention in accordance with claim 16, wherein said power supply includes switching means in series with said latchable trigger circuits for unlatching any one or more which may be latched.

* * * * *